United States Patent [19]

Garrett

[11] 4,296,687

[45] Oct. 27, 1981

[54] SEGMENTED SABOT PROJECTILE

[75] Inventor: Harold E. Garrett, Santa Ana, Calif.

[73] Assignee: The United States of America as represented by the Secretary of the Army, Washington, D.C.

[21] Appl. No.: 57,778

[22] Filed: Jul. 16, 1979

[51] Int. Cl.[3] ..... F42B 13/16

[52] U.S. Cl. ..... 102/518; 102/523

[58] Field of Search ..... 102/93, 52, DIG. 7

[56] References Cited

U.S. PATENT DOCUMENTS

| | | | |
|---|---|---|---|
| 2,983,224 | 5/1961 | Prosen et al. | 102/93 X |
| 3,005,409 | 10/1961 | Dunlap et al. | 102/93 |
| 3,496,869 | 2/1970 | Engel | 102/93 |
| 3,714,900 | 2/1973 | Feldman | 102/52 |
| 3,862,603 | 1/1975 | Kornblith | 102/93 |
| 4,155,308 | 5/1979 | Muiawski | 102/93 |

FOREIGN PATENT DOCUMENTS

| | | | |
|---|---|---|---|
| 2352272 | of 1977 | Fed. Rep. of Germany | 102/93 |
| 1262830 | 5/1980 | Fed. Rep. of Germany | 102/93 |

*Primary Examiner*—Harold J. Tudor

*Attorney, Agent, or Firm*—Peter A. Taucher; John E. McRae; Nathan Edelberg

[57] ABSTRACT

An armor-piercing projectile comprises a penetrator core carried within a discarding segmented sabot equipped with a plastic spinner band. While the core-sabot assembly is traveling through a rifled gun barrel the plastic band interengages with the rifling to impart spin to the assembly. The rifling severs the spinner band so that when the assembly exits from the barrel the sabot segments are centrifugally slung off of the penetrator core. The core continues its flight toward the target. Improved separation of the segments from the core is achieved because the sabot is constructed so that the severable band is the initial mechanism for retaining the sabot segments on the core during feeding and chambering. The separation lines between the core and sabot segments are pre-established by molding alternate segments in two sequential steps. Also, the segments are mechanically locked together, providing a predictable separation mechanism. The sabot can be fabricated from a wide range of materials and with a minimum of process controls.

1 Claim, 10 Drawing Figures

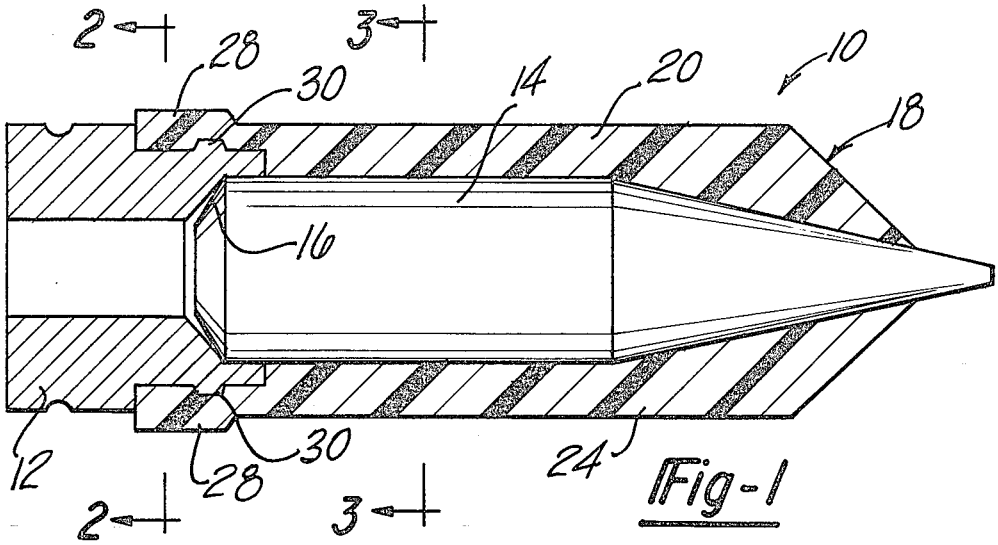
Fig-1
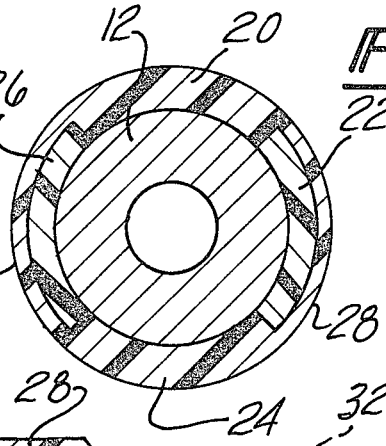
Fig-2
Fig-3
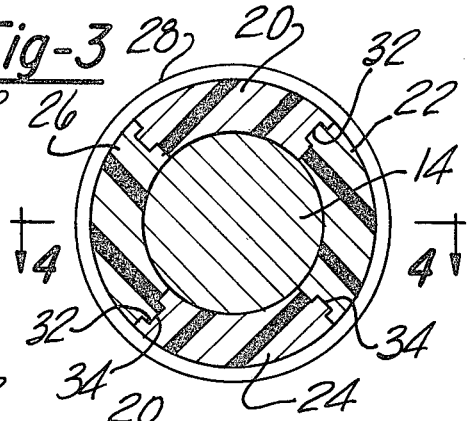
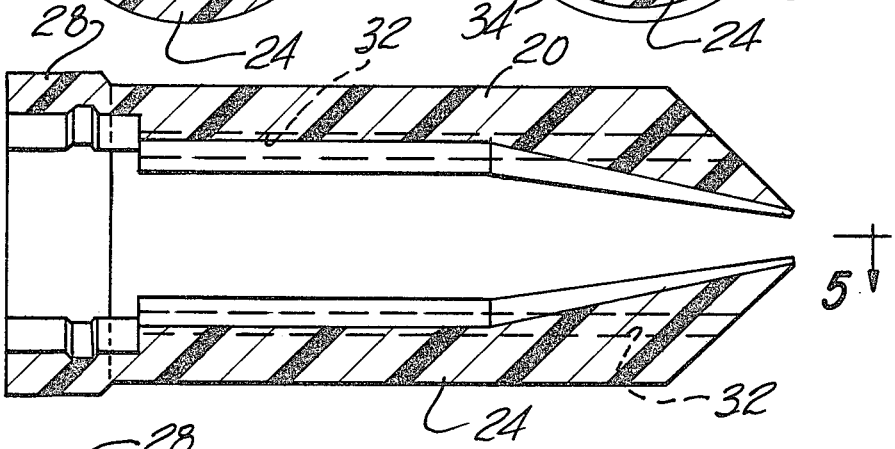
Fig-4
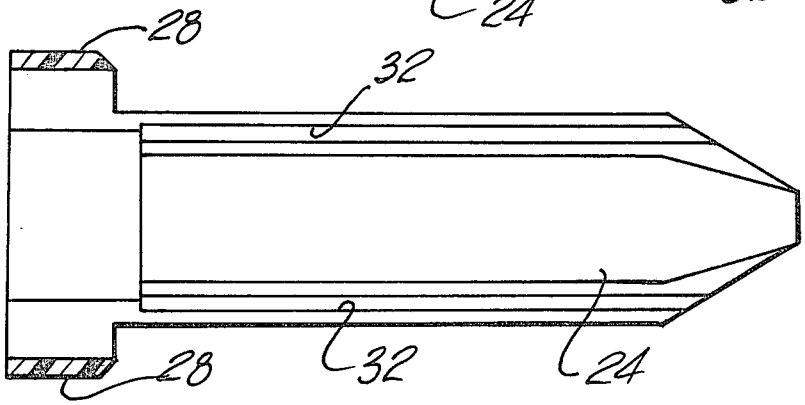
Fig-5

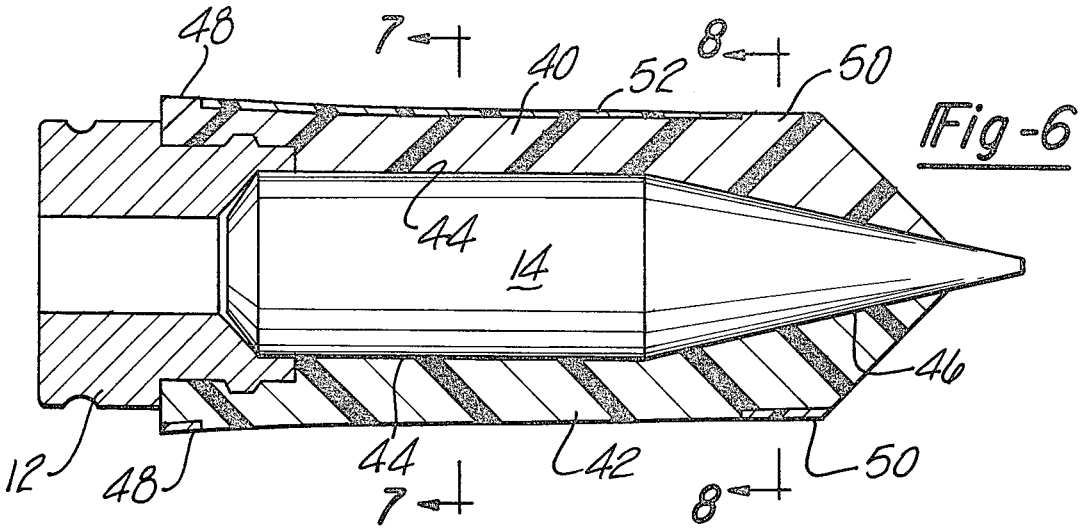
Fig-6
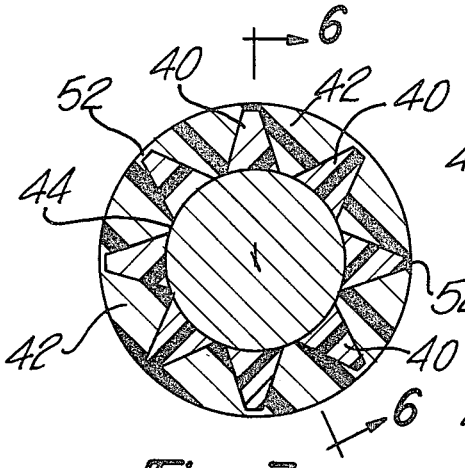
Fig-7
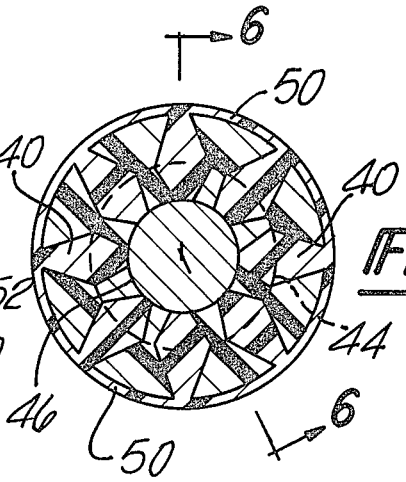
Fig-8
Fig-9
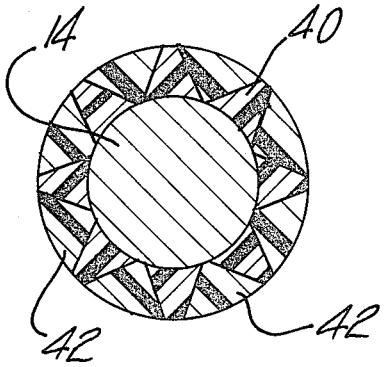
Fig-10
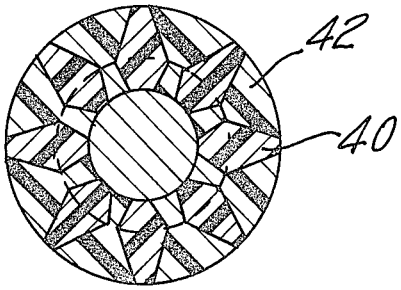

SEGMENTED SABOT PROJECTILE

The invention described herein may be manufactured, used, and licensed by or for the Government for governmental purposes without payment to me of any royalty thereon.

BACKGROUND AND SUMMARY OF THE INVENTION

This invention relates to a sabot-equipped projectile broadly similar to the projectile assemblies shown in U.S. Pat. No. 3,496,869 to Engel and U.S. Pat. No. 3,714,900 to Feldmann. Each of the patented constructions is characterized by a sabot in the form of a plastic sleeve that is frictionally adhered to a centrally located core or penetrator. The plastic sleeve is formed with slots or grooves at evenly spaced points around the sleeve surface, whereby the sleeve is weakened to facilitate centrifugal breakup of the sleeve into segments after exit of the assembly from the gun barrel.

The present invention is directed to a plastic segmented sabot wherein the segments are completely separate from one another at initial manufacture. The segments are held on the penetrator core by a mechanical interlock and/or by one or more plastic bands formed integrally with alternate ones of the segments; gun rifling severs the bands to free the segments for action by centrifugal force as the sabot-penetrator assembly exits from the barrel. Advantages sought by the invention are utilization of a broad range of low cost plastics in preference to expensive materials, uniform separation of the sabot segments from the core, and lack of deflection of the core from its designated flight path during the period when the sabot segments are separating. In this connection it is noted that the sabots described in U.S. Pat. Nos. 3,714,900 and 3,496,869 depend on failure of the plastic material at the most variable points in the plastic molding, i.e. the thinnest cross section. Mechanically interlocked segments, as proposed in the present invention, will have a more uniform or predictable performance due to reliability of the mechanical joints.

The invention described herein may be manufactured, used, and licensed by or for the Government for governmental purposes without payment to me of any royalty thereon.

THE DRAWINGS

FIG. 1 is a longitudinal sectional view taken through a projectile assembly using the present invention.

FIGS. 2 and 3 are transverse sectional views taken on lines 2—2 and 3—3 in FIG. 1.

FIG. 4 is a sectional view on line 4—4 in FIG. 3, but with certain components removed to illustrate internal features.

FIG. 5 is a sectional view on line 5—5 in FIG. 4.

FIG. 6 is a longitudinal sectional view taken through a second projectile assembly incorporating the invention.

FIGS. 7 and 8 are transverse sectional views taken on lines 7—7 and 8—8 in FIG. 6.

FIG. 9 is a view taken on the same line as FIG. 7, but after the spinner bands have been severed from the sabot segments.

FIG. 10 is a view taken on the same line as FIG. 8, but after the spinner bands have been severed from the sabot segments.

The attached drawings represent two methods of applying the concept of this invention in practical embodiments. One embodiment relies on mechanical locks and a retention band that is severed by the gun rifling. The second embodiment includes separate sabot segments that are retained solely by integrally molded bands that are severed by the gun rifling.

Referring in greater detail to FIGS. 1 through 3, there is shown a projectile assembly 10 that comprises a cylindrical metal base 12, a high density penetrator or core 14 seated on the frontal surface 16 of the base, and a plastic sabot 18. Sabot 18 comprises four plastic segments, numbered 20, 22, 24 and 26 in FIG. 3. Segments 20 and 24 are integrally connected to an endless band or ring 28 located at the rear end of the sabot. Segments 22 and 26 are separately formed from the other segments; however all four segments are connected together by a thin annular wafer or spinner band 28 at the aft end of the sabot. The four sabot segments act independently of the spinner band, which functions as an obturator. Retention of segments 22 and 26 on core 14 is primarily due to the fact that each segment 22 or 26 has its rear end area captured between an endless rib 30 on base 12 and the overlying band 28. Retention of segments 22 and 26 on the core is also partially realized by the fact that each segment is formed with a slot or groove 32 along one of its longitudinal side edges and a similarly dimensioned rib 34 on its other longitudinal side edge. The ribs and slots on adjacent segments interfit so that the segments are interlocked together in a fashion best visualized from FIG. 3. The interlock is maintained as long as the endless band 28 remains intact.

The FIG. 1 assembly is formed by molding the plastic components around base 12 and core 14. The components shown in FIG. 4 are molded first; thereafter the two remaining plastic segments 22 and 26 are molded into the circumferential spaces formed by the first molding operation. The molding operations are carried out so that the plastic segments do not adhere to one another or to the base and core. Use of mold release materials on the surfaces of potential adherence will facilitate the desired non-adherent state. Use of different thermo-plastic materials for the different plastic components may also be advantageous although not essential.

The FIG. 1 assembly is initially attached to a non-illustrated cartridge for loading into the breech of the gun. The invention can be utilized in various ammunition sizes; however it was particularly devised for a 25 mm cartridge and plastic sabot fired through a 25 mm gun barrel having eighteen spiral rifling grooves, each about 0.025 inch deep. The diameter of the plastic sabot measured along plane 3—3 in FIG. 1 corresponds to the barrel diameter measured across the land areas of the barrel. The diameter of the plastic sabot measured along plane 2—2 in FIG. 1 corresponds to the barrel diameter measured across the grooves of the barrel. The radial thickness of band 28 corresponds to the rifling groove depth.

During a firing operation the illustrated projectile assembly separates from the cartridge. High pressure gases act on base 12 and the rear end of core 14 to propel the assembly through the rifled barrel. The rifle lands interengage with band 28 to impart spin to the projectile assembly. The rifle lands also completely or almost completely sever band 28 at multiple points around the periphery of the sabot. The severed band has a lessened or non-existent capability for retaining the four segments 20, 22, 24 and 26 in position on the outer surface of core 14. Therefore, as the projectile assembly exits from the gun barrel the four segments are disconnected from one another except for the interlocking connections provided by longitudinal slots 32 and ribs 34. Centrifugal force generated by the rifling grooves causes the segments to readily separate from core 14 in an even pattern, whereby core 14 is precluded from tilting or otherwise deviating from the designated flight path. Segment separation from core 14 is also facilitated by the presence of high pressure gases at the rear face of core 14. The interlock provided by ribs 34 and slots 32 tends to promote equal outward separation of the various segments because the rib-slot connections are required to be broken simultaneously to achieve segment shedding action; it is believed that ribs 34 would tend to promote an even and simultaneous movement of the segments away from core 14.

The process of separating the sabot segments from core 14 is accomplished without any requirement for tearing the sabot segments apart from one another; the segments are pre-formed as separate components, except for the interconnection provided by spinner band 28 and ribs 34. In prior art arrangements relying on a tearing action the individual tearing resistances are sometimes uneven or different, due to the fact that certain pre-weakened areas are thicker or denser than others. The uneven tearing resistances can cause one segment to leave the core before another, thus imparting undesired mechanical or aerodynamic tipping action on the core. The arrangement of FIG. 1 is believed to avoid this problem in a relatively economical low cost fashion that does not require extremely close tolerances on the plastic wall thicknesses. The dimensions of the plastic components are readily controlled by using core 14 and base 12 as mold surfaces; the core is automatically centered within the sabot incident to the first molding operation. Component configuration is such that no inside (male) cores are required for the molding operations; this arrangement facilitates use of multiple cavity molds and high volume output.

FIGS. 6 through 8 illustrate a second embodiment of the invention wherein the sabot is subdivided into sixteen different segments; one group of segments is identified by numeral 40, and the second group of segments is identified by numeral 42. As seen in FIG. 7, segments 40 have essentially triangular cross sections arranged so their base surfaces are contiguous to the cylindrical surface 44 of core 14. In the forward portion of the sabot surrounding ogive portion 46 of the core the segments 40 have essentially diamond cross sections. Segments 42 occupy the intervening spaces between segments 40.

Segments 40 are interconnected together at their front and rear ends by thin spinner bands or rings 48 and 50. Segments 42 are interconnected together by an intermediate band or ring 52. The three bands 48, 50 and 52 collectively form the outer generally cylindrical surface of the assembly; the rearmost portion of the sabot cylindrical surface flares outward slightly to form a spinner band having the same diameter as the barrel rifling diameter measured across the rifling grooves. During the firing operation all three bands 48, 50 and 52 are severed from the sabot, whereby the sabot segments are unconnected as the projectile assembly leaves the gun barrel. FIGS. 9 and 10 illustrate the condition of the sabot as the assembly leaves the barrel.

The multi-piece sabot shown in FIGS. 6 through 8 is formed by a two step molding operation similar to that described in connection with FIG. 1. The molding comprised of segments 40 and associated bands 48 and 50 is preferably formed first, using core 14 and base 12 as mold surfaces. The molding comprised of segments 42 and band 52 is formed second.

The diamond-shaped portions of segments 40 (FIG. 10) have a loose interlocking connection with the intervening segments 42 so that segment movement away from core 14 tends to be simultaneous in spite of disturbing factors. The loose interlock tends to control the segment motions in the sense that the interlocks can only be broken by simultaneous outward motion of all segments; it is difficult for any one segment to explode outwardly before the other segments. Simultaneous movement of the segments is advantageous in that there is then a lessened disturbance on the core flight path.

I wish it to be understood that I do not desire to be limited to the exact details of construction shown and described for obvious modifications will occur to a person skilled in the art.

I claim:

1. A spin-stabilized discarding sabot projectile comprising a base, a core seated on the base, a multi-piece sabot encircling the core and the forward section of the base; said sabot comprising a first set of plastic segments evenly spaced around the core circumference, a second set of plastic segments occupying circumferential spaces between adjacent ones of the first segments, and a plastic spinner band located at the rear end of the sabot to project radially outwardly beyond the sabot side surface, said band being integrally formed with the second set of plastic segments to define a one piece molding; said plastic band having a relatively thin radial dimension corresponding to the rifling thickness in a gun barrel whereby the band is severed by the rifling lands in the gun barrel as the projectile is fired out of the barrel; the plastic band being arranged in surrounding relation to the first plastic segments whereby the band constitutes a mechanism for retaining the plastic segments on the core, such that severing of the band enables the segments to be centrifugally separated from the core as the projectile exits from the gun barrel; each sabot segment having a circumferentially projecting rib (34) in one of its side edges, and a circumferentially projecting slot (32) in its other side edge, the ribs and slots extending forwardly from the aforementioned base to the front end of the sabot, the ribs and slots on adjacent segments being interlocked together only while the projectile is within the gun barrel; the sabot segments having cylindrical outer surfaces cooperatively defining a cylindrical sabot outer surface, said segments occupying the entire circumferential space around the core without any intervening void spaces; one set of plastic segments being formed as a one piece molding using the base and core as a mold surface, the other set of plastic segments being formed by material molded into the circumferential spaces defined by said one segments, adjacent ones of the segments having non-adherent engagement with each other; the ogive portion of the core extending forwardly beyond the sabot segments so that adjacent segments are interconnected solely by the aforementioned plastic band and interlocked rib-slot connections.

* * * * *